US011758318B1

(12) United States Patent
Petrenko et al.

(10) Patent No.: US 11,758,318 B1
(45) Date of Patent: Sep. 12, 2023

(54) HEADPHONE AND HEADSET COMPRISING THE SAME

(71) Applicant: FLATVOX FZC LLC, Ajman (AE)

(72) Inventors: Dmitry Vladimirovich Petrenko, Afipsky (RU); Mikhail Gorden, Dubai (AE)

(73) Assignee: FLATVOX FZC LLC, Ajman (AE)

( * ) Notice: Subject to any disclaimer, the term of this patent is extended or adjusted under 35 U.S.C. 154(b) by 0 days.

(21) Appl. No.: 18/116,451

(22) Filed: Mar. 2, 2023

(51) Int. Cl.
*H04R 1/10* (2006.01)
*H04R 7/00* (2006.01)
*H04R 7/10* (2006.01)

(52) U.S. Cl.
CPC ..... *H04R 1/1075* (2013.01); *H04R 1/105* (2013.01); *H04R 1/1008* (2013.01); *H04R 7/10* (2013.01); *H04R 2307/021* (2013.01); *H04R 2307/027* (2013.01)

(58) Field of Classification Search
CPC . H04R 1/00; H04R 1/028; H04R 1/10; H04R 1/1008; H04R 1/1041; H04R 1/105; H04R 1/1058; H04R 1/1075; H04R 7/00; H04R 7/02; H04R 7/04; H04R 7/06; H04R 7/10; H04R 7/122; H04R 7/125; H04R 9/06; H04R 11/02; H04R 17/00; H04R 10/013; H04R 10/02; H04R 2307/00; H04R 2307/021; H04R 2307/027; H04R 2400/11
See application file for complete search history.

(56) References Cited

U.S. PATENT DOCUMENTS

| | | | | |
|---|---|---|---|---|
| 5,406,038 A * | 4/1995 | Reiff | G06F 1/182 181/167 |
| 2007/0187171 A1* | 8/2007 | Suzuki | H04R 31/003 181/167 |
| 2013/0202134 A1* | 8/2013 | Afshar | H04R 1/2811 29/609.1 |
| 2022/0150639 A1* | 5/2022 | Chai | H04R 9/025 |
| 2022/0201385 A1* | 6/2022 | Corynen | H04R 1/288 |
| 2022/0345821 A1* | 10/2022 | Herger | H04R 7/045 |

FOREIGN PATENT DOCUMENTS

| | | | |
|---|---|---|---|
| CN | 1455618 A * | 11/2003 | H04R 7/02 |
| CN | 206807745 U * | 12/2017 | H04R 7/12 |

* cited by examiner

*Primary Examiner* — Thang V Tran
(74) *Attorney, Agent, or Firm* — Nadya Reingand

(57) ABSTRACT

Aheadphone configured to emit a fractal-polarized sound field is provided. The headphone comprises a sound-emitting membrane, an acoustic oscillator, and an ear pad. The sound-emitting membrane comprises a paper-based composite material layer, a metal layer, and a coating layer. The paper-based composite material layer has a front surface and a rear surface, with the front surface facing a user ear. The metal layer is provided on the front surface of the paper-based composite material layer and configured to reproduce HF acoustic oscillations. The coating layer is provided on the metal layer and has one or more slots through which the metal layer is visible. The coating layer is made of a material incapable of reproducing the HF acoustic oscillations. The acoustic oscillator generating the acoustic oscillations is attached to the rear surface of the paper-based composite material layer. The ear pad is configured to cover the coating layer.

19 Claims, 19 Drawing Sheets

HEADPHONE AND HEADSET COMPRISING THE SAME

TECHNICAL FIELD

The present disclosure relates generally to the field of acoustic engineering. In particular, the present disclosure relates to a headphone configured to emit a fractal-polarized sound field, as well as to a headset comprising such headphones.

BACKGROUND

The prior art discloses a variety of headphones made using various technologies. The most widely used headphones are isodynamic headphones. In fact, the isodynamic headphone is a compact speaker that is enclosed in a housing of various configurations and configured to be fixed on a user head, for example, by using a headband, an ear mount, or in anear canal. Some examples of the isodynamic headphones include, but are not limited to: Audeze LCD X, HiFiMan Susvara, Abyss AB-1266, Kennerton Thror, Meze Empyrean, IzoPhones-OS, Dan Clark Audio AEON 2 Noire, Dekoni Audio Blue Fostex/Dekoni Audiophile HiFi, MrSpeakers ETHER C, Audeze LCDi4. However, the isodynamic headphones suffer from the following obvious disadvantages: the inability to provide a natural sound parameter and to ensure the uniformity of an amplitude-frequency response curve ina frequency range above 2 kHz, a high level of non-linear harmonic distortion especially in a high-frequency region, as well as discomfort from long listening.

There are also headphones made using the magneto-planar (MP) technology, which are less prone to the above-indicated disadvantages. Since reciprocating movements are performed by a large-area membrane enclosed, on both sides, by a magnetic circuit that creates magnetic tension over the entire area of the membrane, the coefficient of non-linear harmonic distortion is relatively lower compared to the isodynamic headphones. Also, the linearity of the amplitude-frequency response curve of the MP-based headphones is relatively higher than that of the isodynamic headphones. However, the natural sound parameter is still at a low level since the design of the MP-based headphones does not provide for their operation in the conditions of fractal-polarized sound field generation. Similar disadvantages are peculiar to the electrostatic headphone manufacturing technology (e.g., Audeze CRBN, HIFIMAN Shangri-La Jr, etc.).

U.S. Pat. No. 4,837,838 (6 Jun. 1989) discloses an electromagnetic transducer that comprises elongated magnetic strips fixed, on both sides, with a flat flexible thin-film diaphragm. When excited by an electric current, conductive conductors connected to the diaphragm cause the diaphragm to move. However, this design suffers from the following disadvantages: a low acoustic wave flux density, low acoustic performance, and an insufficient structural strength.

RU 2751582 (15 Jul. 2021) discloses a planar electrodynamic electro-acoustic transducer with a matrix structure based on equilateral triangles. This transducer comprises a diaphragm and magnets arranged at a certain distance from the diaphragm to ensure the impact of their electromagnetic field on the diaphragm. The adjacent magnets differ from each other by the arrangement of their polarities relative to the diaphragm. There is a conductive track on the diaphragm in the intervals between the magnets. The shape of the conductive track forms a matrix of triangular equilateral cells of two types. The sections of the conductive track which surround each cell of the first type have a clockwise direction of current, while the sections of the conductive track which surround each cell of the second type have a counterclockwise direction of current. The magnets are divided into two types according to the arrangement of their polarities relative to the diaphragm. The magnets of the first type are arranged in the centers of the cells of the first type, while the magnets of the second type are arranged in the centers of the cells of the second type. However, the disadvantage of this transducer design is as follows: the occurrence of transient and phase distortions due to the inevitable processes of the diaphragm deformation. Due to the operation of the diaphragm in a reciprocating mode over its entire surface, no conditions are created for generating a fractal-polarized sound field. Furthermore, due to the high non-uniformity of the amplitude-frequency response curve, the original timbres of acoustic signals are distorted.

SUMMARY

This summary is provided to introduce a selection of concepts in a simplified form that are further described below in the detailed description. This summary is not intended to identify key features of the present disclosure, nor is it intended to be used to limit the scope of the present disclosure.

It is an objective of the present disclosure to provide a headphone that is configured to emit the fractal-polarized sound field.

The objective above is achieved by the features of the independent claims in the appended claims. Further embodiments and examples are apparent from the dependent claims, the detailed description, and the accompanying drawings.

According to a first aspect, a headphone is provided, which comprises a sound-emitting membrane, an acoustic oscillator, and an ear pad. The sound-emitting membrane comprises a paper-based composite material layer, a metal layer, and a coating layer. The paper-based composite material layer has a front surface and a rear surface, with the front surface facing a user ear. The metal layer is provided on the front surface of the paper-based composite material layer and configured to reproduce HF acoustic oscillations. The coating layer is provided on the metal layer and has at least one slot through which the metal layer is visible. The coating layer is made of a material incapable of reproducing the HF acoustic oscillations. The acoustic oscillator is attached to the rear surface of the paper-based composite material layer and configured to generate the acoustic oscillations. The ear pad covers the coating layer. In the headphone thus configured, suitable conditions may be created for the formation of acoustic radiation in the form of the fractal-polarized sound field. Furthermore, the headphone thus configured may reduce the level of non-linear harmonic distortion and achieve a sound quality closer to "natural sound", i.e., provide accurate reproduction of timbres. On top of that, it is possible to adjust the parameters of the amplitude-frequency response curve at the stage of designing and manufacturing the headphone. The headphone also has a reduced (compared to the prior art analogues) weight, as well as a simplified design and manufacturing process.

In one exemplary embodiment of the first aspect, the sound-emitting membrane has a geometrical shape calculated based on an elastic modulus of a paper-based composite material of the paper-based composite material layer. By using the membrane shape thus calculated, it is possible to improve the acoustic performance of the headphone.

In one exemplary embodiment of the first aspect, the elastic modulus of the paper-based composite material differs in longitudinal and transverse directions of the sound-emitting membrane by 2 times. The membrane in which the elastic modulus of the paper-based composite material changes in this way may improve the acoustic performance of the headphone even more.

In one exemplary embodiment of the first aspect, the sound-emitting membrane has a length-to-width ratio from 1 to 1.5, preferably 1.135. Such sizes of the membrane may improve the acoustic performance of the headphone even more (especially when the membrane also has an octagonal shape).

In one exemplary embodiment of the first aspect, the sound-emitting membrane is shaped as a polygon. The polygonal shape of the sound-emitting membrane may improve the acoustic performance of the headphone even more.

In one exemplary embodiment of the first aspect, the paper-based composite material comprises two flat paper layers and a layer of corrugated, foam or honeycomb material sandwiched between the two flat paper layers. Such a paper-based composite material layer may additionally improve the acoustic performance of the headphone.

In one exemplary embodiment of the first aspect, each of the two flat paper layers is impregnated with one of Bakelite varnish, epoxy resin, polyester resin, polyurethane resin, and nitrocellulose resin. By using such impregnation, it is possible to give necessary physical and mechanical properties to the paper-based composite material layer (and, consequently, to the whole membrane structure). For example, such impregnation with the stabilizing composition may provide the desired elasticity modulus and elasticity-to-viscosity ratio of the paper-based composite material layer (e.g., an increase in its viscosity leads to a decrease in the speed of propagation of bending waves over the membrane surface and a change in tonal balance towards a decrease in a lower cutoff frequency), as well as lead to leveling the membrane surface (in order to reduce the level of non-linear harmonic distortion) and protect the membrane from moisture changes.

In one exemplary embodiment of the first aspect, the paper-based composite material layer further comprises two levelling layers each provided on one of the two flat paper layers. By using the levelling layers, it is possible to achieve desired membrane surface smoothness. It should be noted that the property of surface smoothness reduces a distortion coefficient at high and medium frequencies, and the thickness of the levelling layer affects the ability of the surface to emit the medium frequencies in the range from 500 Hz to 8 kHz, thereby reducing the intensity of their generation.

In one exemplary embodiment of the first aspect, each of the two levelling layers is made of one of Bakelite, epoxy resin, polyester resin, polyurethane resin, nitrocellulose resin, and flexible plastic. The levelling layers made of any of these materials may provide efficient levelling of the membrane surfaces.

In one exemplary embodiment of the first aspect, the coating layer is made of one of fabric, fleece, fluffy paper, and foam rubber. The coating layer made of any of these materials may have a limited ability to radiate frequencies above 8 kHz by its surface, thereby improving the acoustic performance of the headphone.

In one exemplary embodiment of the first aspect, the sound-emitting membrane further comprises at least one variable-diameter hole passing through the paper-based composite material layer, the metal layer, and the coating layer. The variable-diameter hole(s) may reduce an acoustic pressure in the space between the user ear and the membrane when it is required to reduce the acoustic pressure at low frequencies (LFs).

In another exemplary embodiment of the first aspect, the ear pad has at least one variable-diameter hole. The variable-diameter hole(s) may reduce the acoustic pressure in the space between the user ear and the membrane when it is required to reduce the acoustic pressure at LFs.

In one exemplary embodiment of the first aspect, the headphone further comprises an acoustic amplifier attached to the rear surface of the paper-based composite material layer. In this embodiment, the acoustic oscillator is coupled to the acoustic amplifier. By using the acoustic amplifier, it is possible to obtain the desired amplitude of the acoustic oscillations.

In one exemplary embodiment of the first aspect, the headphone further comprises two ring-like elastic spacers and a rear cover. In this embodiment, the ear pad is attached to the rear cover such that the sound-emitting membrane is fixed by using the two ring-like elastic spacers between the ear pad and the rear cover. This embodiment may be useful when it is required to avoid using any screw fasteners—the ear pad may cover the periphery of the sound-emitting membrane, thereby holding onto it, and fasten to the rear cover, thereby connecting all the components of the headphone into a single whole. In this case, the headphone assembly process may be simplified and shortened, and its cost may be reduced.

In another exemplary embodiment of the first aspect, the headphone further comprises two ring-like elastic spacers and a hollow housing having an opening. In this embodiment, the sound-emitting membrane is mounted inside the hollow housing by using the two ring-like elastic spacers such that the coating layer faces the opening of the hollow housing. The ear pad is attached to the hollow housing such that the ear pad covers the opening of the hollow housing. Such a housing may provide better (compared to the embodiment with the rear cover) acoustic insulation and mechanical protection of the components of the headphone.

In yet another exemplary embodiment of the first aspect, the headphone further comprises a hollow housing having an opening. In this embodiment, the sound-emitting membrane is mounted in the opening of the hollow housing such that the coating layer faces the ear pad, and the ear pad is attached to the hollow housing such that the ear pad covers the opening of the hollow housing. Optionally, the hollow housing may comprise an additional opening arranged opposite to the opening in which the sound-emitting membrane is mounted, and the headphone may further comprise a subwoofer mounted in the additional opening. Such a housing may provide better (compared to the embodiment with the rear cover) acoustic insulation and mechanical protection of the components of the headphone. Furthermore, the subwoofer may be used to additionally generate LF sound oscillations, if necessary.

According to a second aspect, a headset is provided, which comprises two headphones according to the first aspect and a connection means connecting the two headphones and configured to be worn on a user head. The headset thus configured may generate the fractal-polarized sound field and has similar advantages as those discussed above with reference to the headphone.

In one exemplary embodiment of the second aspect, the connection means is configured as one of a headband, a hat, a forehead band, a helmet, a cap, glasses, and goggles. The possibility of using different types of the connection means may make the headset according to the second aspect more flexible in use.

Other features and advantages of the present disclosure will be apparent upon reading the following detailed description and reviewing the accompanying drawings.

BRIEF DESCRIPTION OF THE DRAWINGS

The present disclosure is explained below with reference to the accompanying drawings in which.

DETAILED DESCRIPTION OF THE PREFERRED EMBODIMENT

Figure 1:
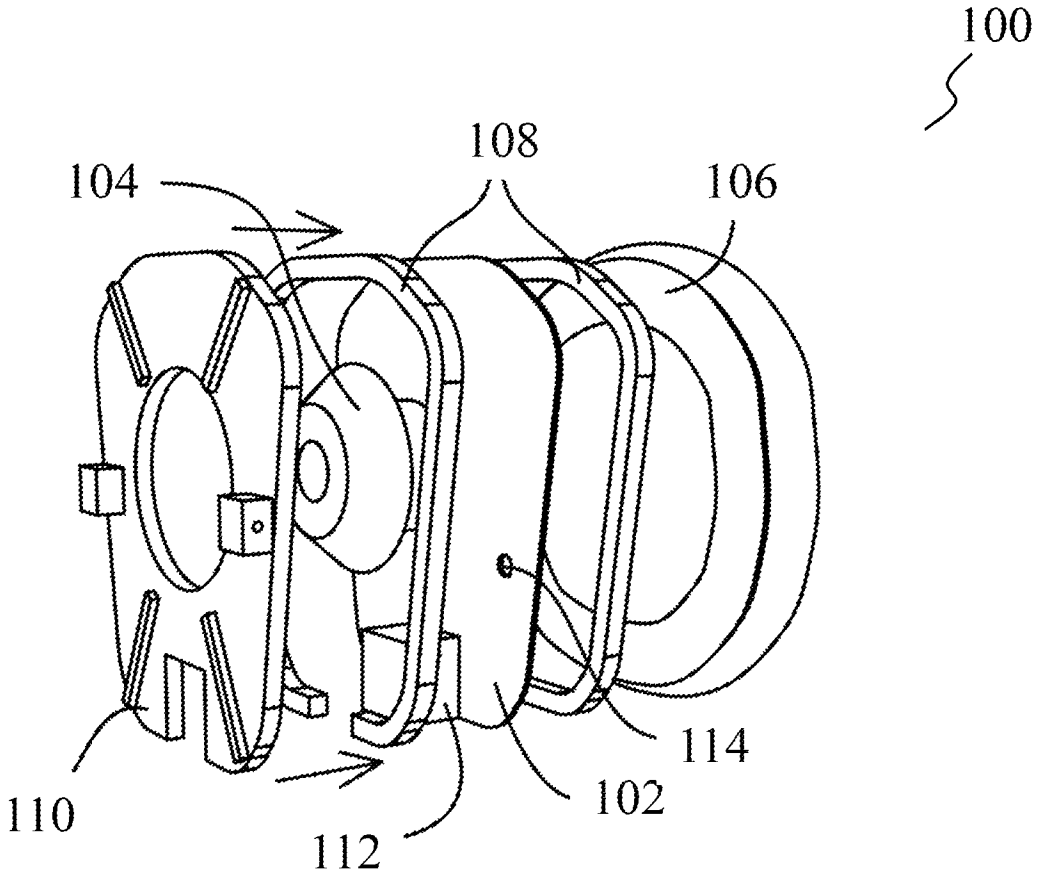
FIG. 1 shows a schematic exploded view of a headphone in accordance with a first exemplary embodiment.

Various embodiments of the present disclosure are further described in more detail with reference to the accompanying drawings. However, the present disclosure may be embodied in many other forms and should not be construed as limited to any certain structure or function discussed in the following description. In contrast, these embodiments are provided to make the description of the present disclosure detailed and complete.

According to the detailed description, it will be apparent to the ones skilled in the art that the scope of the present disclosure encompasses any embodiment thereof, which is disclosed herein, irrespective of whether this embodiment is implemented independently or in concert with any other embodiment of the present disclosure. For example, the apparatuses disclosed herein may be implemented in practice by using any numbers of the embodiments provided herein. Furthermore, it should be understood that any embodiment of the present disclosure may be implemented using one or more of the features presented in the appended claims.

The word "exemplary" is used herein in the meaning of "used as an illustration". Unless otherwise stated, any embodiment described herein as "exemplary" should not be construed as preferable or having an advantage over other embodiments.

Any positioning terminology, such as "left", "right", "top", "bottom", "above" "below", "upper", "lower", "horizontal", "vertical", "front", "rear", etc., may be used herein for convenience to describe one element's or feature's relationship to one or more other elements or features in accordance with the figures. It should be apparent that the positioning terminology is intended to encompass different orientations of the apparatus disclosed herein, in addition to the orientation(s) depicted in the figures. As an example, if one imaginatively rotates the apparatus in the figures 90 degrees clockwise, elements or features described as "left" and "right" relative to other elements or features would then be oriented, respectively, "above" and "below" the other elements or features. Therefore, the positioning terminology used herein should not be construed as any limitation of the invention.

Although the numerative terminology, such as "first", "second", etc., may be used herein to describe various embodiments, elements or features, these embodiments, elements or features should not be limited by this numerative terminology. This numerative terminology is used herein only to distinguish one embodiment, element or feature from another embodiment, element or feature. For example, a first embodiment may be called a second embodiment, and vice versa, without departing from the teachings of the present disclosure.

As used in the exemplary embodiments disclosed herein, the fractal-polarized sound field may refer to a sound field that occurs when a flat membrane is bent under the influence of an applied acoustic vibration, thereby providing a pair of incoherent sources of standing waves which generate anti-phase acoustic vibrations of one frequency or another into a surrounding space. Since these sources are spaced from each other over the membrane area, this results in forming zones of transverse polarization of sound, as well as zones of intermediate polarization of sound in the surrounding (air or gas) space. Thus, a spatial sound pattern consisting of the zones of different polarizations of sound is formed. This pattern is formed according to the following equation of fractal regularities (also referred to as the logistic difference equation): $x_{n+1}=rx_n(1-x_n)$, where r is the so-called driving parameter. The resulting fractal sound pattern is unique for each of the generated frequencies, both in terms of the size of the polarization zones and their geometry. In case of a broadband acoustic signal, this gives a huge variety of spatial fractal-polarized sound patterns, which allows providing a high degree of filling of the surrounding space with acoustic energy.

It should be noted that the conventional headphones are designed without considering the above-described principle of formation of the fractal-polarized sound field. Therefore, the conventional headphones may have an insufficient sound quality (i.e., do not provide the effect of "natural sound"), a non-uniform amplitude-frequency response curve in a frequency range above 2 kHz, a high level of non-linear harmonic distortion (especially in a high-frequency (HF) region), as well as cause user discomfort from long listening.

The exemplary embodiments disclosed herein relate to a headphone that is configured to emit the fractal-polarized sound field. More specifically, the headphone comprises a sound-emitting membrane, an acoustic oscillator, and an ear pad. The sound-emitting membrane comprises a paper-based composite material layer, a metal layer, and a coating layer. The paper-based composite material layer has a front surface and a rear surface, with the front surface facing a user ear. The metal layer is provided on the front surface of the paper-based composite material layer and configured to reproduce HF acoustic oscillations. The coating layer is provided on the metal layer and has one or more slots through which the metal layer is visible. The coating layer is made of a material incapable of reproducing the HF acoustic oscillations. The acoustic oscillator generating the acoustic oscillations is attached to the rear surface of the paper-based composite material layer. The ear pad is configured to cover the coating layer.

FIG. 1 shows a schematic exploded view of a headphone 100 in accordance with a first exemplary embodiment. The headphone 100 comprises a sound-emitting membrane 102, an acoustic oscillator 104, an ear pad 106, two ring-like elastic spacers 108, and a rear cover 110. The acoustic oscillator 104 is configured to generate acoustic oscillations. In the exemplary embodiments disclosed herein, the acoustic oscillations may refer to sound of which the frequency lies between 8 and 20 kHz. The acoustic oscillator 104 may of any type, such as electrodynamic, piezoelectric, hydraulic, and is attached (e.g., glued) to the rear surface of the membrane 102. In some embodiments, the acoustic oscillator 104 may be connected either to an external acoustic amplifier or to a built-in acoustic amplifier 112 also attached to the rear surface of the membrane 102. Each of the spacers 108 is shaped as a ring extending along the periphery of the membrane 102 from one of its front and rear sides. The ear pad 106 acts as cushioning and provide grip between the headphone 100 and a user ear which is assumed to be behind the ear pad 106 in FIG. 1. In the first exemplary embodiment, the ear pad 106 is assumed to pulled over the periphery of the membrane 102 and then fastened to the rear cover 110, thereby connecting all the components of the headphone 100 into a single whole.

Figure 2:
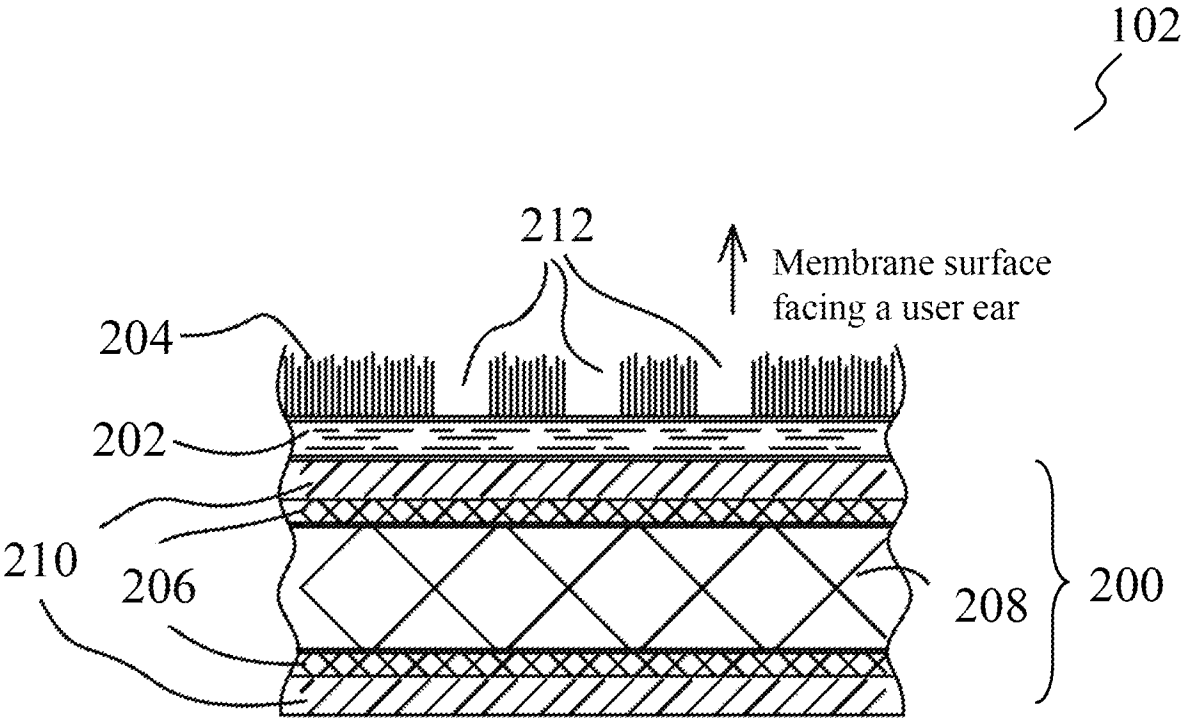
FIG. 2 shows a schematic side view of a sound-emitting membrane included in the headphone of FIG. 1.

FIG. 2 shows a schematic side view of the membrane 102 included in the headphone 100. The membrane 102 comprises a paper-based composite material layer 200, a metal layer 202, and a coating layer 204. Each of these layers of the membrane 102 will be discussed below in more detail.

The paper-based composite material layer 200 has a front (upper) surface and a rear (bottom) surface, with the front surface facing the user ear (as schematically shown by the arrow in FIG. 2). The paper-based composite material 200 comprises two flat paper layers 206 and a layer 208 of corrugated, foam or honeycomb material sandwiched between the two flat paper layers 206. Optionally (e.g., when it is required to give desired physical and mechanical properties to the paper-based composite material layer 200 and, consequently, to the whole membrane 102), each of the two flat paper layers 206 may be impregnated with Bakelite varnish, epoxy resin, polyester resin, polyurethane resin, nitrocellulose resin, or any other composition suitable for the impregnation of paper. As also follows from FIG. 2, the paper-based composite material layer 200 further comprises two levelling layers 210 each provided on one of the two flat paper layers 206. The levelling layers 210 may be made of similar materials as the above-discussed impregnation for the flat paper layers 206. In addition, flexible plastic may be also used as the basis material of the levelling layers 210. It should be noted that the levelling layers 210 are optional and may be used when it is required to achieve desired smoothness of the front and rear surfaces of the paper-based composite material layer 200.

The metal layer 202 is provided on the front surface of the paper-based composite material layer 200 (i.e., on the front (upper) levelling layer 210 in the example shown in FIG. 2) and configured to reproduce the HF acoustic oscillations (i.e., in the range of 8-20 kHz) generated by the acoustic oscillator 104. The acoustic oscillator 104 (and the built-in acoustic amplifier, if present) is attached to the rear surface of the paper-based composite material layer 200 (i.e., to the rear (bottom) levelling layer 210 in the example shown in FIG. 2). Preferably, the metal layer 202 is made of aluminum, but any other metals may be used as well, depending on particular applications.

The coating layer 204 is provided on the metal layer 202 and has slots 212 through which the metal layer 202 is visible. The coating layer 204 is made of a material incapable of reproducing the HF acoustic oscillations, such as fabric, fleece, fluffy paper, or foam rubber. It would be apparent to those skilled in the art that the number, arrangement, and shape of the slots 212, which are shown in FIG. 2, are not intended to be any limitation of the present disclosure, but merely used to provide a general idea of how the slots 212 may be made in the coating layer 204 of the membrane 102. For example, the slots 212 may have any straight, angled or curved (e.g., annular, zigzag, polygonal, etc.) shape. In some embodiments, the slots 212 may be similarly or differently shaped (e.g., one part of the slots 212 may have an annular shape, while another part of the slots 212 may be in the form of zigzag). One other embodiment is possible, in which the coating layer 204 has only one slot 212. In general, the shape, size, and number of the slots 212 may be any, depending on a specific technical problem aimed at achieving a desired balance in the emission of different frequencies by the surface of the membrane 102. In other words, by changing the shape, size, and number of the slots 212, it is possible to control the return of sound energy by the membrane 102 in a particular frequency range. Further, the number and shape of the slots 212 influence a sound pattern formed on the surface of the membrane 102. Since the metal layer 202 may radiate higher frequencies more energetically, and the coating layer 204 may radiate lower frequencies only, then the shape and size of such a sound pattern may control the balance of the energy of the return of sound waves by the membrane 102 in the entire frequency range of the membrane 102.

It is worth noting that the whole complex of the coatings or layers of the membrane 102 may affect the overall viscosity and elasticity of the membrane 102. For example, the lower the elasticity and the higher the viscosity, the lower the speed of surface waves of bending vibrations and the lower the cut-off frequency of the headphone 100.

Figure 3:
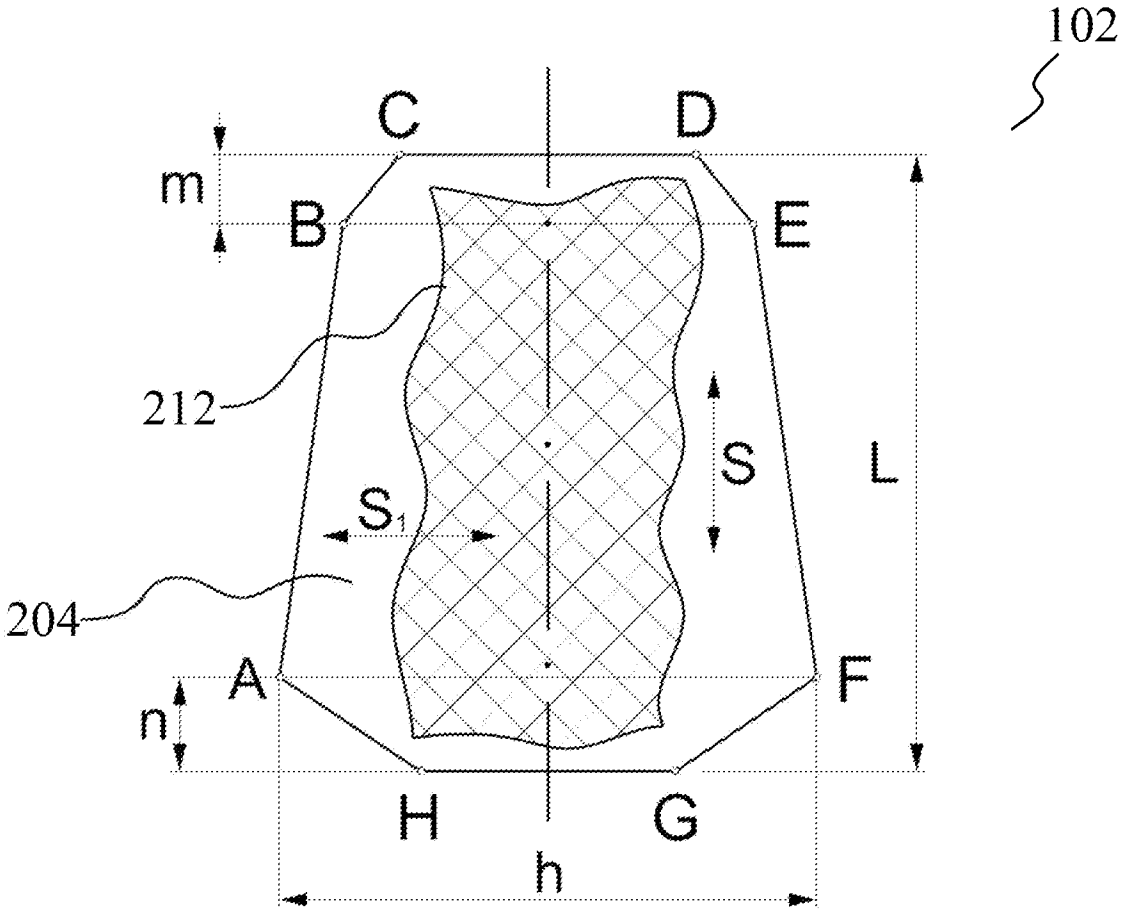
FIG. 3 explains how to calculate the geometry of the membrane of FIG. 2.

FIG. 3 explains how to calculate the geometry of the membrane 102. The shape and dimensions of the membrane 102 are critical to provide good acoustic performance of the headphone 100. When viewed from the front, the membrane 102 may be an octagon having vertices A, B, C, D, E, F, G, and H. The basis for calculating the geometry of the membrane 102 is an elastic modulus of the material selected for the paper-based composite material layer 200. As noted above, this material may be made in the form of a three-layer structure comprising the three-dimensional base 208 (corrugated, honeycomb, foam, or other similar material) and the flat paper layers 206 glued to the three-dimensional base 208 on both sides. The geometry of the paper-based composite material layer 200 may be calculated based on the difference in the elasticity modulus in longitudinal and transverse directions according to the following formula: $S/S1=½$, where S is the elasticity modulus in the longitudinal direction, S1 is the elasticity modulus in the transverse direction. For calculations, the elasticity modulus of a suitable material is calculated in millinewton/meter(mN/m). The elasticity modulus S is the basis for determining the absolute length L of the membrane 102 in mm according to the following formula: $L=28*S$ (mN/m). A factor of 28 is optimal but may range from 18 to 38. The absolute width h of the membrane 102 is determined by the following ratio: L/h=1.135 (this ratio may vary from 1 to 1.5 in different embodiments, but the ratio value of 1.135 is preferable, e.g., for the octagonal membrane 102). The remaining proportions of the membrane 102 are determined according to the following list of ratios: AF/HG=1.9; HG=CD; L/n=6; n/m=1.35; AF/BE=1.35. The fact that the membrane 102 is made symmetrical about is vertical axis is also taken into account.

It should be apparent to those skilled in the art that the present disclosure is not limited to the octagonal shape of the membrane 102. The octagonal membrane 102 is preferable, but any other membrane shape (e.g., other polygonal shapes, such as square, triangular, rectangular, etc.) is also possible (for such other membrane shapes, one may use similar calculations as those given above with reference to FIG. 3). Furthermore, if necessary, the corners of the membrane 102 may be rounded.

Figure 4:
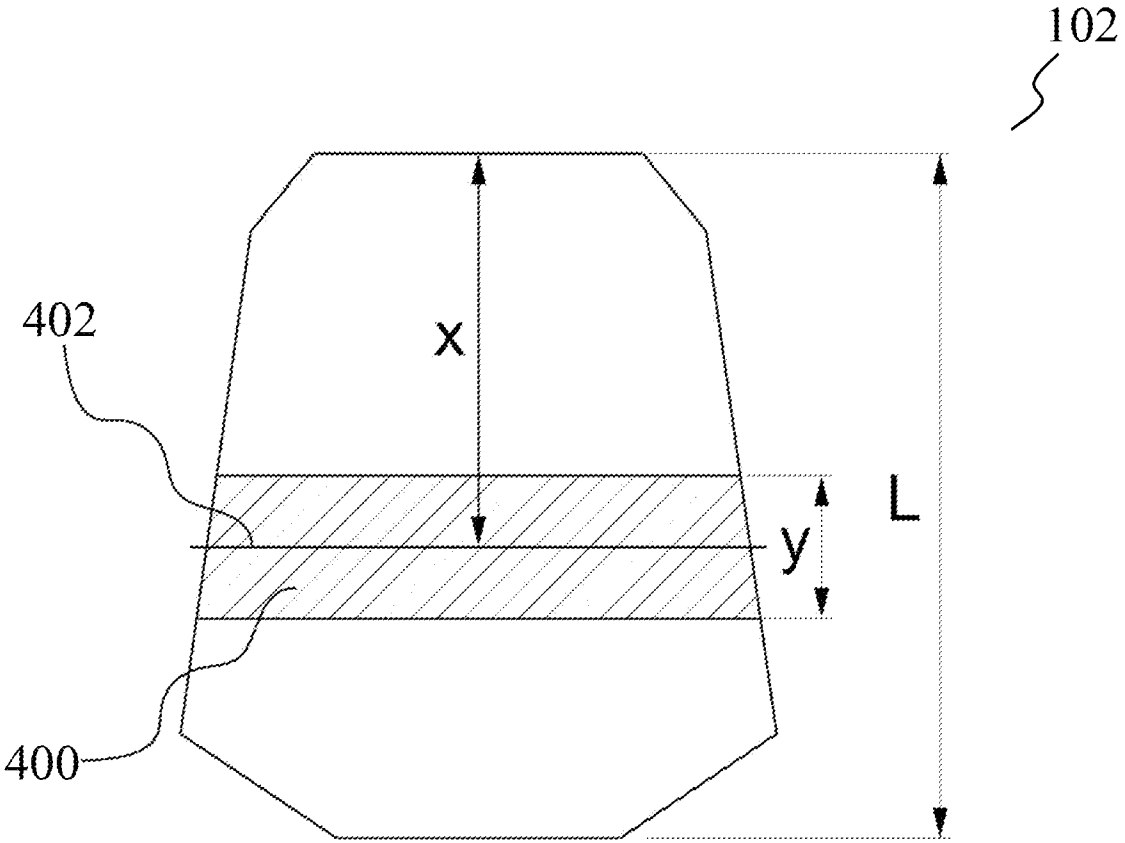
FIG. 4 shows a possible zone of attachment of an acoustic oscillator included in the headphone of FIG. 1 to the membrane of FIG. 2.

FIG. 4 shows a zone 400 of possible attachment of the acoustic oscillator 104 included in the headphone 100 to the membrane 106. In FIG. 4, a line 402 corresponds to a fastening line of the center of the acoustic oscillator 104, and its position may vary within the zone 400. The zone 400 has a width y, and the line 402 is positioned at a distance x from the top end of the membrane 102. To calculate y and x, one may use the following ratios: L/y=4, and L/x=1.8. By selecting an attachment point for the acoustic oscillator 104 within the zone 400, the linearity of the amplitude-frequency response curve may be improved.

Referring back to FIG. 1, the membrane 102 may optionally comprise a hole 114 passing through the paper-based composite material layer 200, the metal layer 202, and the coating layer 204. This hole has a calibrated diameter and provides a way to regulate the amplitude of a low-frequency signal. In another embodiment, a valve configured to adjust the cross section of such a hole may be used; such a valve may be arranged within the area of the membrane 102 and communicate with the space or cavity between the user ear and the membrane 102 on one side and with the surrounding atmosphere on another side. In some other embodiments, there may be an arbitrarily large number of such holes, up to the perforation of the whole membrane 102. Such a hole or holes are necessary to reduce an acoustic pressure in the space or cavity between the user ear and the membrane 102 when it is required to reduce the acoustic pressure at low frequencies. The diameter of the hole 114 or the sum of the diameters of such holes is selected empirically or by calculation to provide a necessary low-frequency pressure in the space or cavity between the user ear and the membrane 102. This "calibrated" hole(s) is(are) then fixed in the manufacturing process of the headphone 100. In some other embodiments, similar hole(s)may be made in any other component(s) of the headphone 100, for example, in the ear pad 106.

Figure 5:
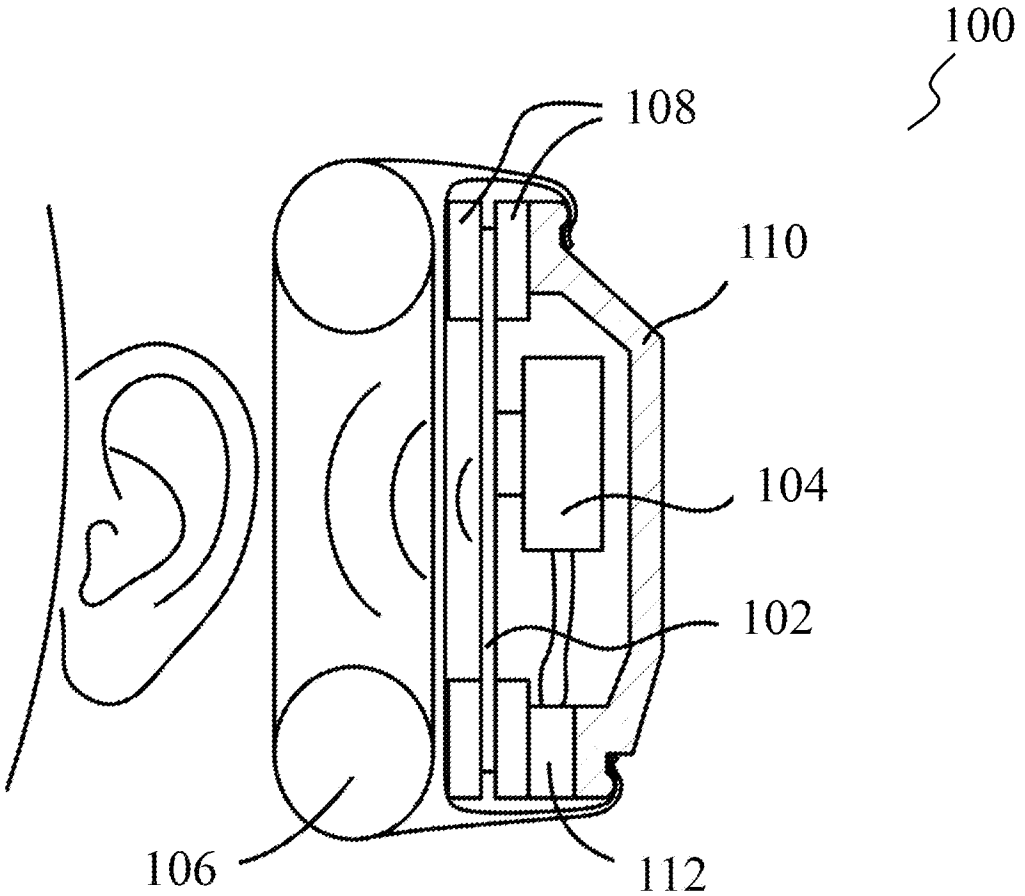
FIG. 5 shows a schematic side sectional view of the headphone of FIG. 1 in the assembled condition.

FIG. 5 shows a schematic side sectional view of the headphone 100 in the assembled condition. As shown in FIG. 5, when the ear pad 106 is pulled over the periphery of the membrane 102 and fastened to the rear cover 110, the membrane 102 is fixed by using the spacers 108 between the ear pad 106 and the rear cover 110. In other words, the membrane 102 is sandwiched between the spacers 108 along its periphery.

Figure 6:
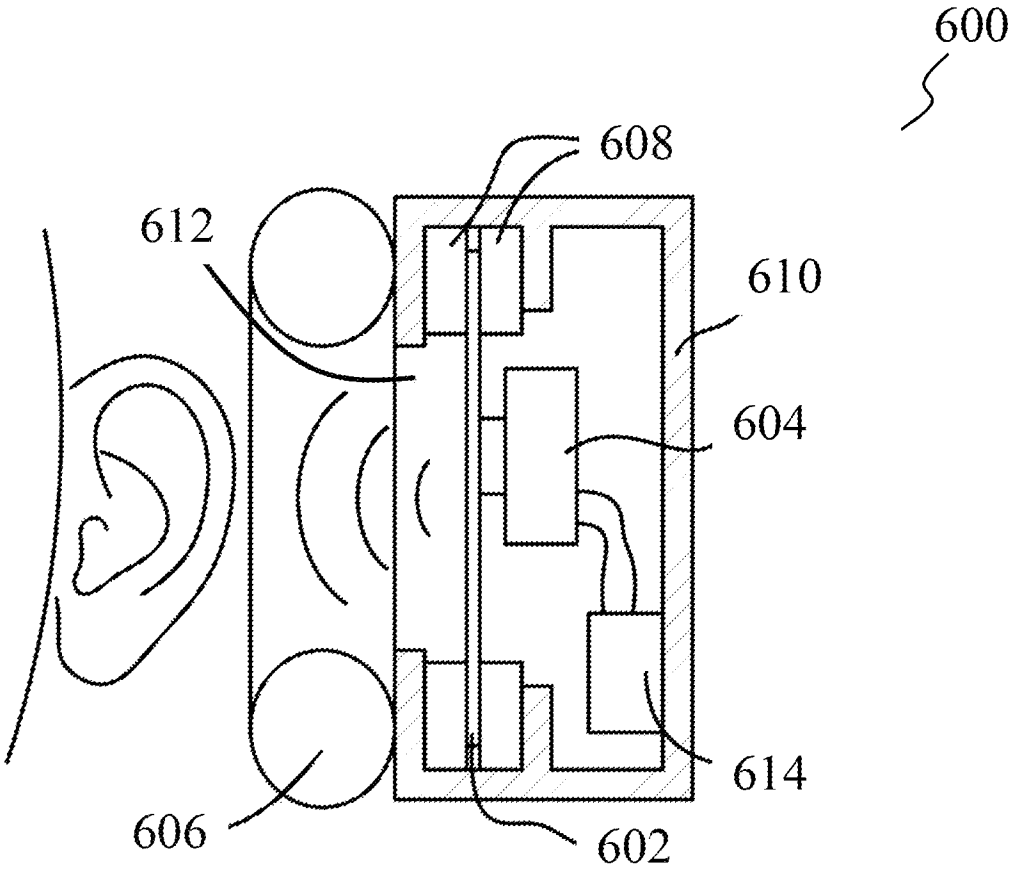
FIG. 6 shows a schematic side sectional view of a headphone in accordance with a second exemplary embodiment.

FIG. 6 shows a schematic side sectional view of a headphone 600 in accordance with a second exemplary embodiment. The headphone 600 comprises a sound-emitting membrane 602, an acoustic oscillator 604, an ear pad 606, and two ring-like elastic spacers 608, which may be implemented in the same or similar manner as the sound-emitting membrane 102, the acoustic oscillator 104, the ear pad 106, and the two ring-like elastic spacers 108, respectively. At the same time, the headphone 600 differs from the headphone 100 in that there is no rear cover—instead, a hollow housing 610 is used, which accommodates the membrane 602, the acoustic oscillator 604, and the spacers 608. The housing 610 may be made of a sound-absorbing material, a sound-scattering material, or a sound-transparent material. The housing 610 has an opening 612, and the membrane 602 is mounted inside the housing 610 such that its coating layer faces the opening 612. The ear pad 606 is attached to the housing 610 such that it covers the opening 612. In an optional embodiment, the headphone 600 may further comprise a built-in acoustic amplifier 614 which may be attached to the inner surface of the housing 610 near the acoustic oscillator 604.

Figure 7:
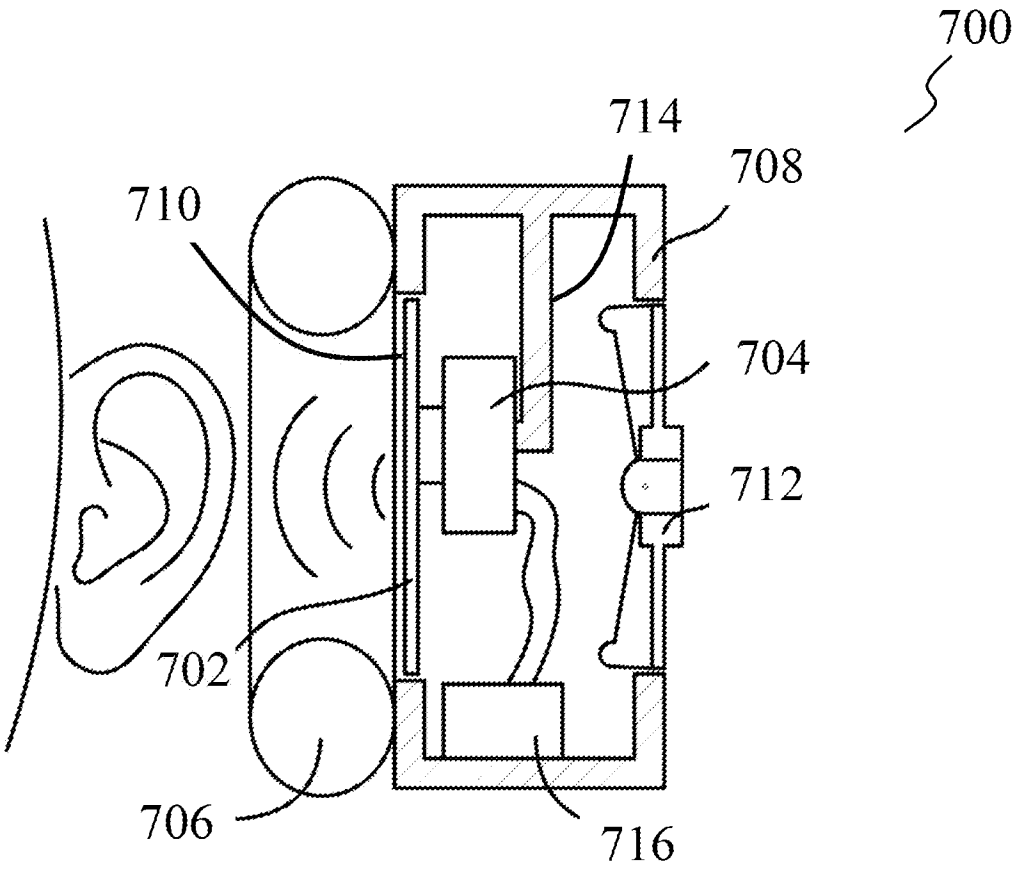
FIG. 7 shows a schematic side sectional view of a headphone in accordance with a third exemplary embodiment.

FIG. 7 shows a schematic side sectional view of a headphone 700 in accordance with a third exemplary embodiment. The headphone 700 comprises a sound-emitting membrane 702, an acoustic oscillator 704, and an ear pad 706, which may be implemented in the same or similar manner as the sound-emitting membrane 102, the acoustic oscillator 104, and the ear pad 106, respectively. At the same time, the headphone 700 differs from the headphone 100 in that there is no rear cover—instead, a hollow housing 708 is used, which may be made of a sound-absorbing material, a sound-scattering material, or a sound-transparent material. The housing 708 has an opening 710, and the membrane 702 is mounted in the opening 710 such that its coating layer faces the ear pad 706. The ear pad 706 is attached to the housing 708 such that it covers the opening 710. In this embodiment, the acoustic oscillator 704 may be mounted on a protrusion 714 inside the housing 708 and, therefore, serve as a support for the membrane 702, allowing the membrane 702 to be in the opening 710. In one optional embodiment, the housing 708 may have an additional opening arranged opposite to the opening 710, and the headphone 700 may further comprise a subwoofer 712 mounted in the additional opening. In one more optional embodiment, the headphone 700 may further comprise a built-in acoustic amplifier 716 which may be attached to the inner surface of the housing 708 near the acoustic oscillator 704.

Figure 8:
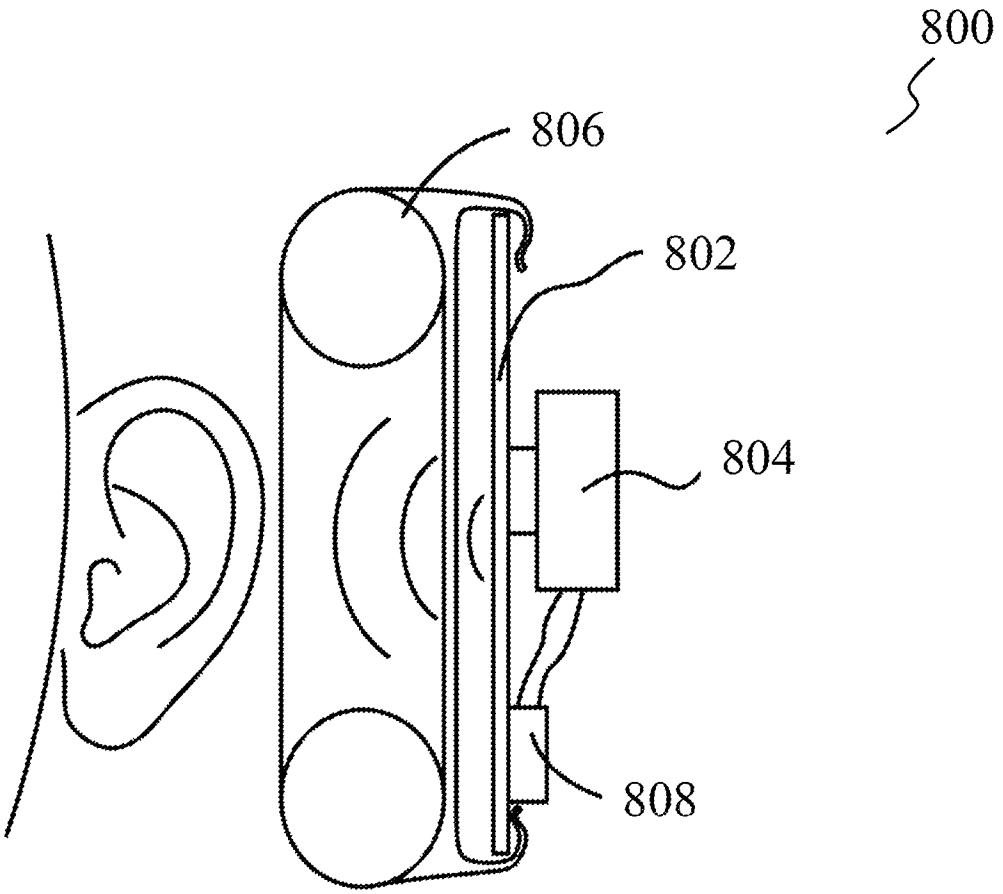
FIG. 8 shows a schematic side sectional view of a headphone in accordance with a fourth exemplary embodiment.

FIG. 8 shows a schematic side sectional view of a headphone 800 in accordance with a fourth exemplary embodiment. The headphone 800 comprises a sound-emitting membrane 802, an acoustic oscillator 804, and an ear pad 806, which may be implemented in the same or similar manner as the sound-emitting membrane 102, the acoustic oscillator 104, and the ear pad 106, respectively. At the same time, the headphone 800 differs from the headphones 100, 600, 700 in that it does not have a rear cover or a hollow housing—instead, a "naked" headphone design is used, in which the ear pad 806 is pulled over the membrane 802 and attached to the rear surface of the membrane 802. In an optional embodiment, the headphone 800 may further comprise a built-in acoustic amplifier 808 which may be attached to the rear surface of the membrane 802 near the acoustic oscillator 804.

Each of the headphones 100, 600-800 provides the following advantages: compactness and design simplicity combined with excellent acoustic properties; controllable characteristics of the amplitude-frequency response curve during the headphone production, an unsurpassed natural sound parameter, an extremely low weight. For example, the weight of LCD-5 Flagship Headphones is 420 g, HEDD phone is 730 g, and the headphones 100, 600-800 have a weight from 170 g to 250 g. Thus, the headphones 100, 600-800 can provide a competitive advantage in audio-demanding areas of acoustics, such as hi-fi, hi-end, professional headphones for sound engineers, conference calls, military in-ear monitors, in which the quality and audibility of command feedback are crucial.

Figure 9A:
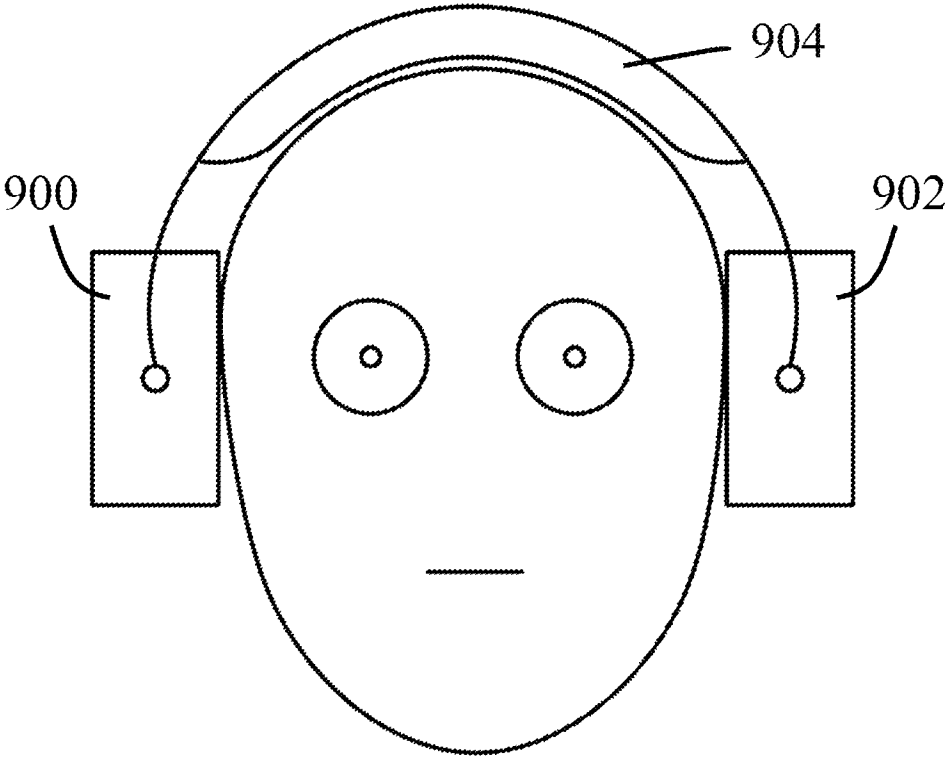
FIGS. 9A-9H show different ways of holding headphones of any of FIGS. 1, 6, 7, and 8 on a user head.
Figure 9B:
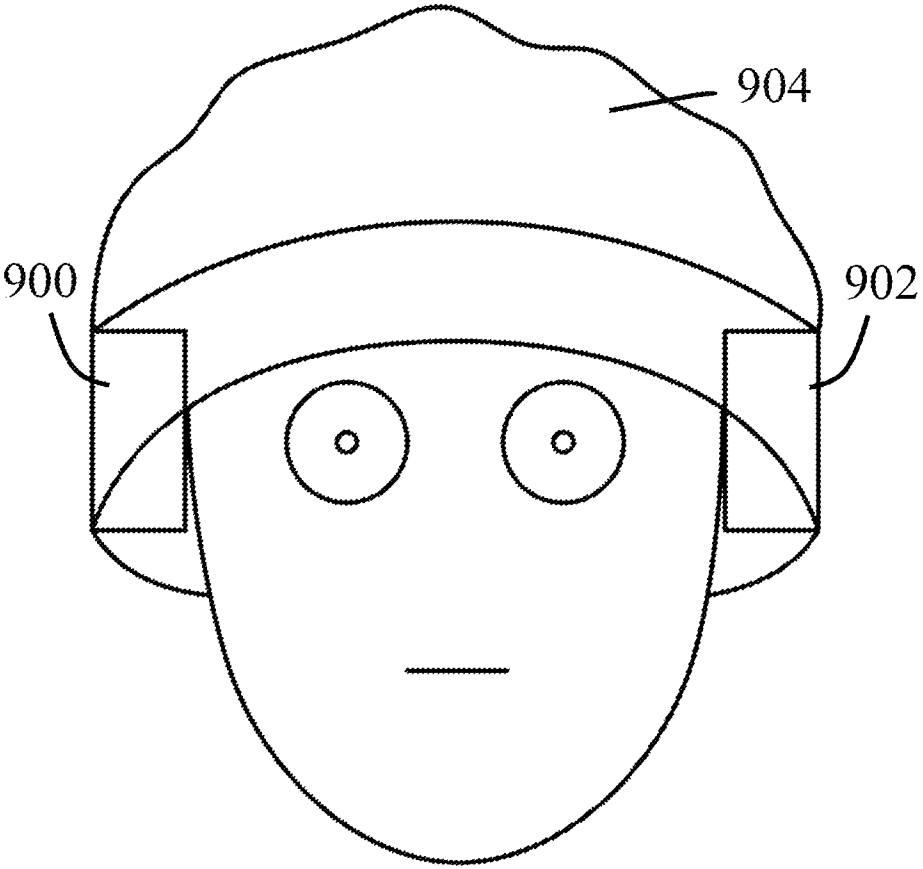
Figure 9C:
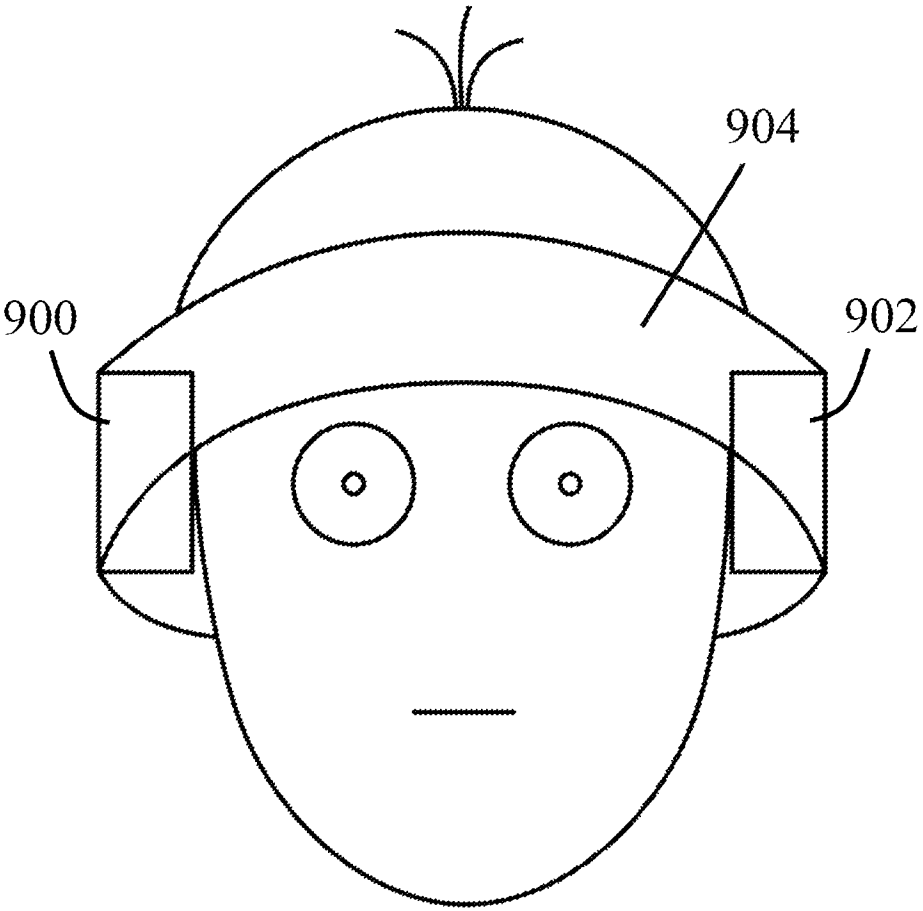
Figure 9D:
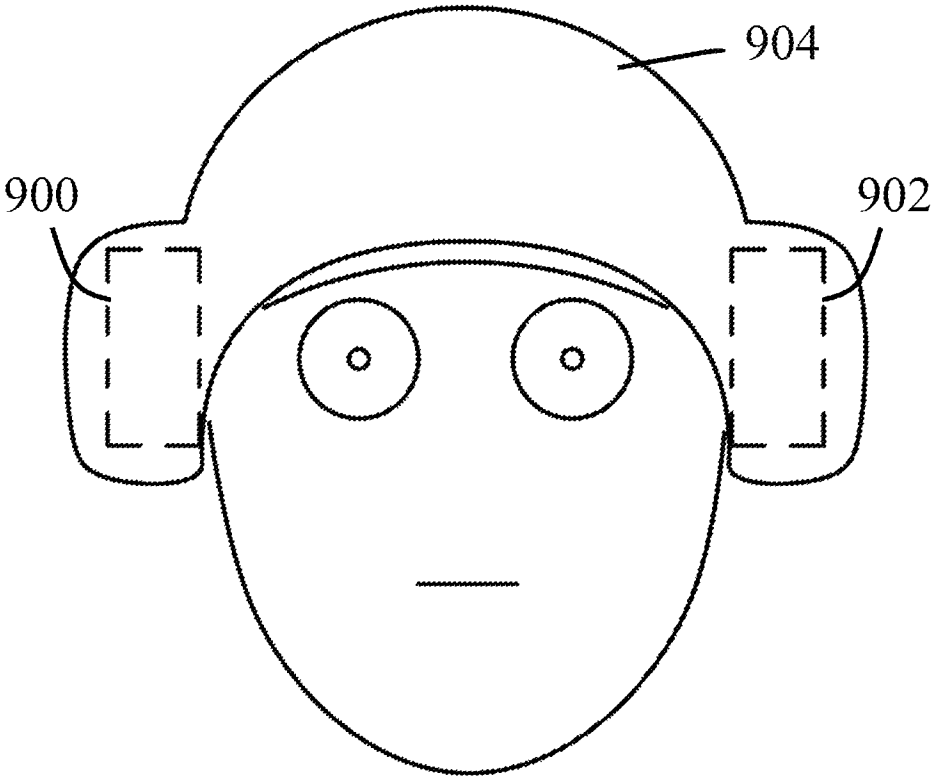
Figure 9E:
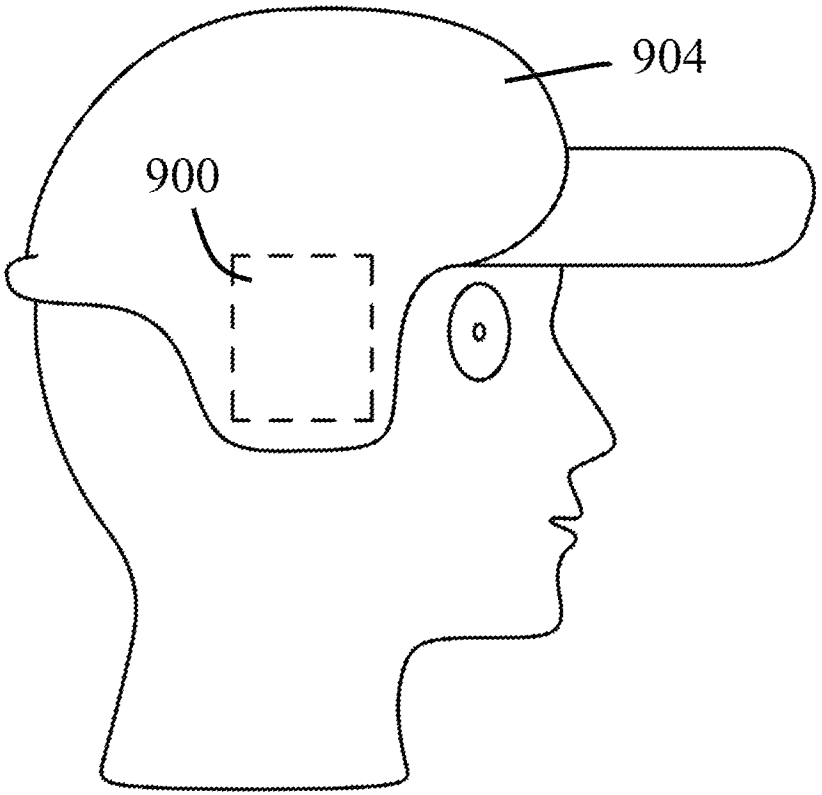
Figure 9F:
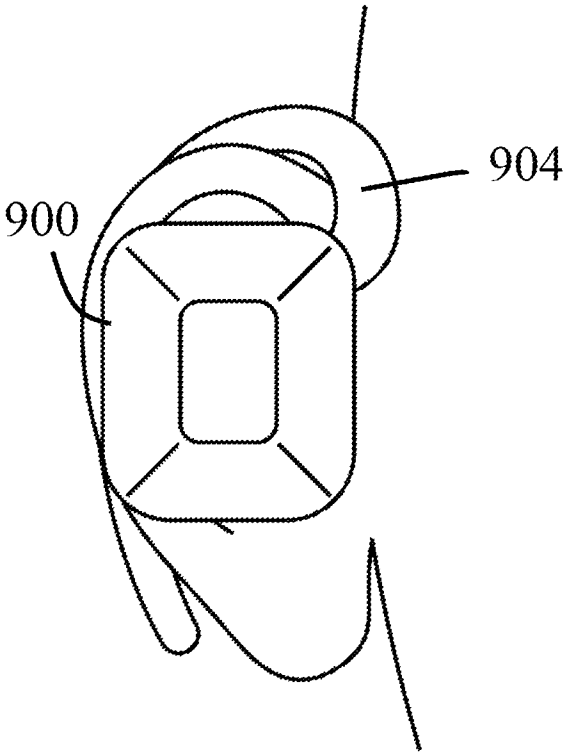
Figure 9G:
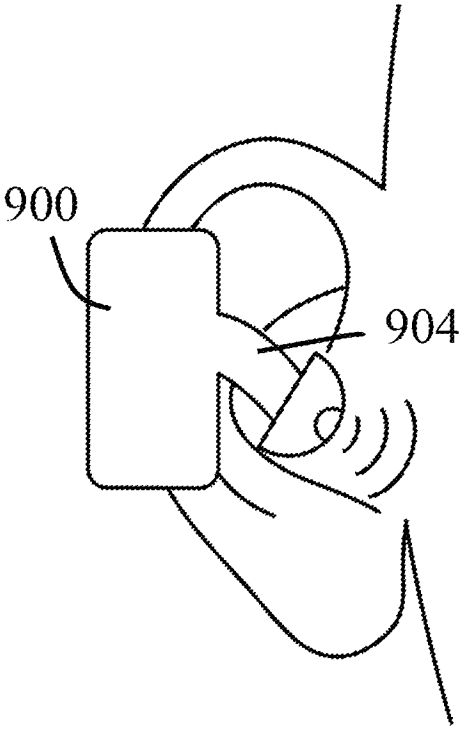
Figure 9H:
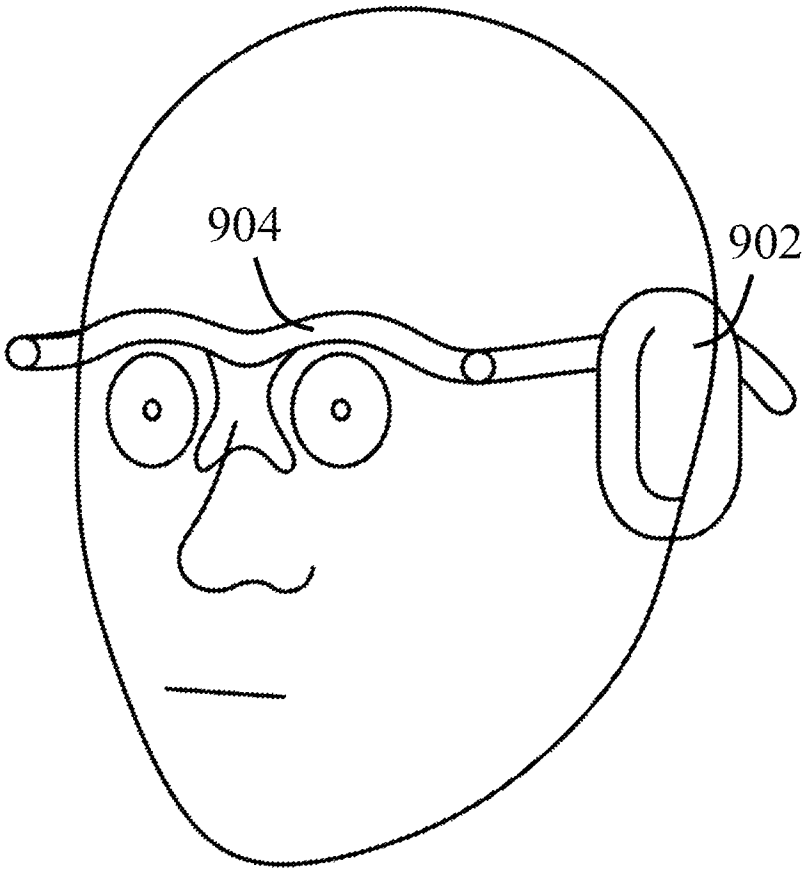

FIGS. 9A-9H show different ways of holding headphones on a user head. More specifically, each of FIGS. 9A-9H shows a certain headset comprising two headphones 900 and 902 and their connection means 904 configured to be worn on a user head. Each of the headphones 900 and 902 is assumed to be implemented as one of the headphones 100, 600-800. In FIG. 9A, the connection means 904 is configured as an elastic headband. In FIG. 9B, the connection means 904 is configured as a hat, with the headphones 900 and 902 being attached to its inside. In FIG. 9C, the connection means 904 is configured as a forehead band holding the headphones 900 and 902 (i.e., pressing them against the user head). In FIG. 9D, the connection means 904 is configured as a helmet, with the headphones 900 and 902 being installed therein. In FIG. 9E, the connection means 904 is configured as a cap with the built-in headphones 900 and 902 (the latter is not shown in FIG. 9E). In FIG. 9F, the connection means 904 is configured as an ear hook around the user ear. In FIG. 9G, the connection means 904 is configured as an in-ear holder. In FIG. 9H, the connection means 904 is configured as glasses of different types (e.g., goggles).

Figure 10A:
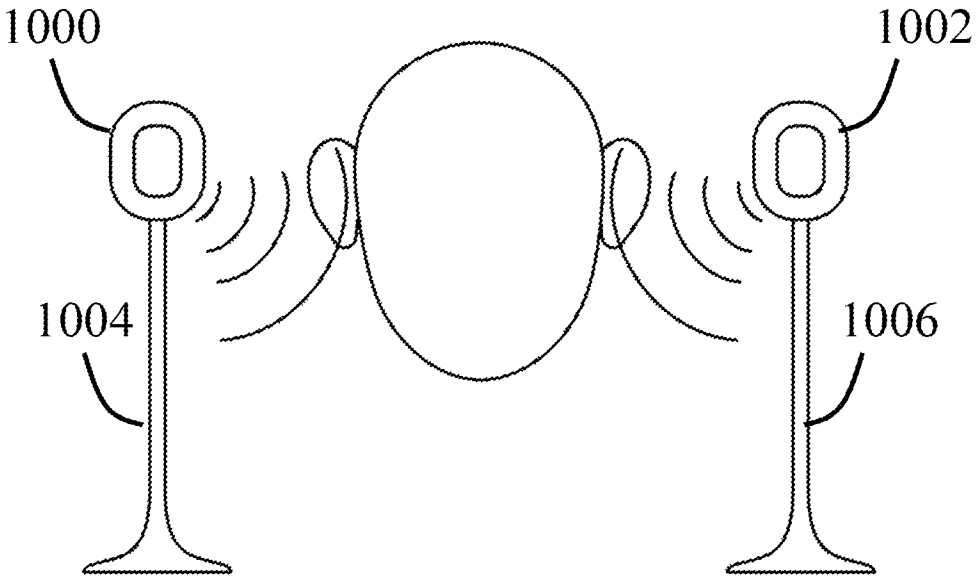
FIGS. 10A-10C explain how the headphone of any of FIGS. 1, 6, 7, and 8 may be used as a sound column (FIG. 10A), a portable speaker (FIG. 10B), and an external acoustic system (FIG. 10C).
Figure 10B:
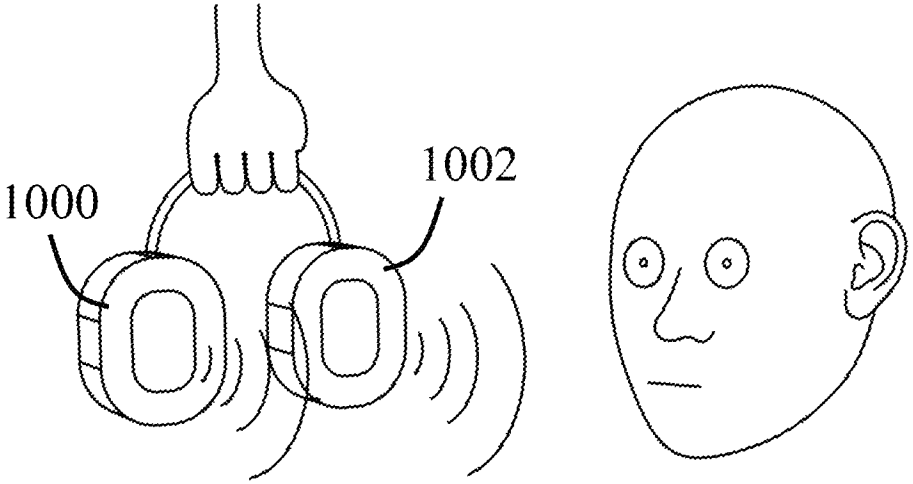
Figure 10C:
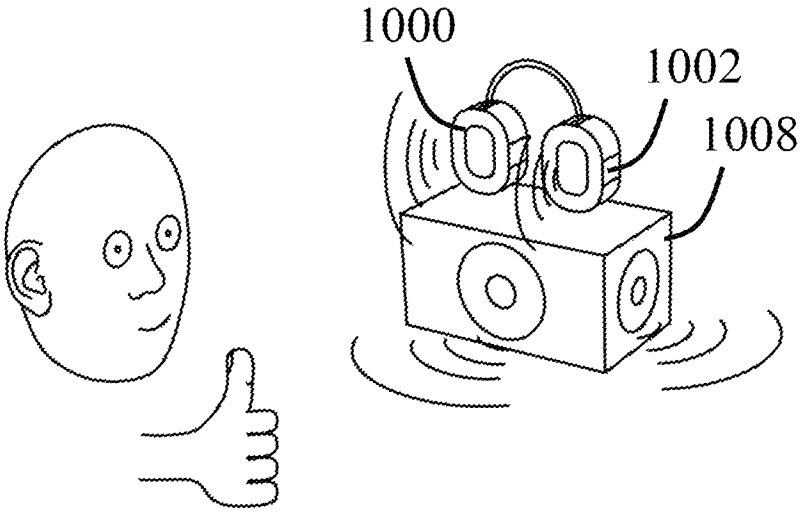

FIGS. 10A-10C show alternative ways of using the headphones according to the present disclosure. More specifically, each of FIGS. 10A-10C shows two headphones 1000 and 1002, each of which is assumed to be implemented as one of the headphones 100, 600-800. In FIG. 10A, the headphones 1000 and 1002 are mounted on sound columns or stands 1004 and 1006, respectively, which are at a distance from a user head. In FIG. 10B, the headphones 1000 and 1002 are used as a portable speaker, such as a boombox. In FIG. 10C, the headphones 1000 and 1002 are used as an external speaker system connected to a docking station 1008 having a built-in subwoofer.

Although the exemplary embodiments of the present disclosure are described herein, it should be noted that any various changes and modifications could be made in the embodiments of the present disclosure, without departing from the scope of legal protection which is defined by the appended claims. In the appended claims, the word "comprising" does not exclude other elements or operations, and the indefinite article "a" or "an" does not exclude a plurality. The mere fact that certain measures are recited in mutually different dependent claims does not indicate that a combination of these measures cannot be used to advantage.

What is claimed is:

1. A headphone comprising:

a sound-emitting membrane comprising:

a paper-based composite material layer having a front surface and a rear surface, the front surface facing a user ear;

a metal layer provided on the front surface of the paper-based composite material layer and configured to reproduce high frequency (HF) acoustic oscillations; and a coating layer provided on the metal layer and having at least one slot through which the metal layer is visible, the coating layer being made of a material incapable of reproducing the HF acoustic oscillations;

an acoustic oscillator attached to the rear surface of the paper-based composite material layer and configured to generate the acoustic oscillations; and an ear pad covering the coating layer.

2. The headphone of claim 1, wherein the sound-emitting membrane has a geometrical shape calculated based on an elastic modulus of a paper-based composite material of the paper-based composite material layer.

3. The headphone of claim 2, wherein the elastic modulus of the paper-based composite material differs in longitudinal and transverse directions of the sound-emitting membrane by 2 times.

4. The headphone of claim 1, wherein the sound-emitting membrane has a length-to-width ratio from 1 to 1.5.

5. The headphone of claim 1, wherein the sound-emitting membrane is shaped as a polygon.

6. The headphone of claim 1, wherein the paper-based composite material layer comprises:

two flat paper layers; and a layer of corrugated, foam or honeycomb material sandwiched between the two flat paper layers.

7. The headphone of claim 6, wherein each of the two flat paper layers is impregnated with one of Bakelite varnish, epoxy resin, polyester resin, polyurethane resin, and nitrocellulose resin.

8. The headphone of claim 6, wherein the paper-based composite material layer further comprises two levelling layers each provided on one of the two flat paper layers.

9. The headphone of claim 8, wherein each of the two levelling layers is made of one of Bakelite, epoxy resin, polyester resin, polyurethane resin, nitrocellulose resin, and flexible plastic.

10. The headphone of claim 1, wherein the coating layer is made of one of fabric, fleece, fluffy paper, and foam rubber.

11. The headphone of claim 1, wherein the sound-emitting membrane further comprises at least one variable-diameter hole passing through the paper-based composite material layer, the metal layer and the coating layer.

12. The headphone of claim 1, wherein the ear pad has at least one variable-diameter hole.

13. The headphone of claim 1, further comprising an acoustic amplifier attached to the rear surface of the paper-based composite material layer, and wherein the acoustic oscillator is coupled to the acoustic amplifier.

14. The headphone of claim 1, further comprising:

two ring-like elastic spacers; and a rear cover;

wherein the ear pad is attached to the rear cover such that the sound-emitting membrane is fixed by using the two ring-like elastic spacers between the ear pad and the rear cover.

15. The headphone of claim 1, further comprising:

two ring-like elastic spacers; and a hollow housing having an opening;

wherein the sound-emitting membrane is mounted inside the hollow housing by using the two ring-like elastic spacers such that the coating layer faces the opening of the hollow housing; and wherein the ear pad is attached to the hollow housing such that the ear pad covers the opening of the hollow housing.

16. The headphone of claim 1, further comprising a hollow housing having an opening, and wherein the sound-emitting membrane is mounted in the opening of the hollow housing such that the coating layer faces the ear pad, and wherein the ear pad is attached to the hollow housing such that the ear pad covers the opening of the hollow housing.

17. The headphone of claim 16, wherein the hollow housing further comprises an additional opening arranged opposite to the opening in which the sound-emitting membrane is mounted, and wherein the headphone further comprises a subwoofer mounted in the additional opening.

18. A headset comprising:

two headphones according to claim 1; further comprising a connection means connecting the two headphones and configured to be worn on a user head.

19. The headset of claim 18, wherein the connection means is configured as one of a headband, a hat, a forehead band, a helmet, a cap, glasses, and goggles.

* * * * *